United States Patent [19]

Harader

[11] 4,296,416

[45] Oct. 20, 1981

[54] DUAL MODE LOG PERIODIC MONOPOLE ARRAY

[75] Inventor: Wayne R. Harader, Garland, Tex.

[73] Assignee: E-Systems, Inc., Dallas, Tex.

[21] Appl. No.: 88,564

[22] Filed: Oct. 26, 1979

[51] Int. Cl.[3] ..... H01Q 11/10

[52] U.S. Cl. ..... 343/792.5; 343/846

[58] Field of Search ..... 343/792.5, 846, 908

[56] References Cited

U.S. PATENT DOCUMENTS

| | | | |
|---|---|---|---|
| 3,013,268 | 12/1961 | DuHamel et al. | 343/792.5 |
| 3,059,234 | 10/1962 | DuHamel et al. | 343/792.5 |
| 3,110,030 | 11/1963 | Cole | 343/792.5 |
| 3,113,316 | 12/1963 | Berry | 343/792.5 |
| 3,127,611 | 3/1964 | DuHamel et al. | 343/792.5 |
| 3,249,946 | 5/1966 | Flanagan | 343/792.5 |
| 3,266,044 | 8/1966 | Bresler | 343/792.5 |
| 3,271,775 | 9/1966 | Yang | 343/792.5 |
| 3,308,470 | 3/1967 | Bell | 343/792.5 |
| 3,349,404 | 10/1967 | Copeland et al. | 343/792.5 |
| 3,369,243 | 2/1968 | Greiser | 343/792.5 |
| 3,460,150 | 7/1969 | Mei | 343/792.5 |
| 3,633,207 | 1/1972 | Ingerson et al. | 343/792.5 |
| 3,715,759 | 2/1973 | Esposito et al. | 343/792.5 |
| 4,005,432 | 1/1977 | Beccario | 343/792.5 |
| 4,054,886 | 10/1977 | Bergander et al. | 343/792.5 |

*Primary Examiner*—Eli Lieberman

*Attorney, Agent, or Firm*—Robert V. Wilder; Albert M. Crowder, Jr.

[57] ABSTRACT

A dual mode log periodic monopole antenna for simultaneously receiving and transmitting radio frequency energy that includes a conducting cone (10) with four log periodic monopole elements (12 through 15) extending radially therefrom and operational in a first mode. Four additional log periodic elements (16 through 19) are interspersed between the elements (12 through 15) and are also connected to and extend radially from the conducting cone (10). The second four log periodic elements (16 through 19) are interconnected for operation in a second mode. Each of the eight log periodic monopole elements (12 through 19) consists of a single planar substrate (24) of a dielectric material having a conducting pattern (26) thereon. A coaxial cable (22) is connected to the monopole elements (12 through 15) and a coaxial cable (20) is connected to the monopole elements (16 through 19).

12 Claims, 4 Drawing Figures

DUAL MODE LOG PERIODIC MONOPOLE ARRAY

TECHNICAL FIELD

This invention relates to antennas and more particularly to dual mode antennas wherein the radiating elements thereof are comprised of log periodic monopole elements mounted on a conducting cone.

BACKGROUND ART

Log periodic antennas have several desirable properties including maintaining a relatively constant radiation pattern over relatively large frequency bands, that is, they are considered broadband antennas. In the construction of most log periodic antennas the radiating element is a tapered or triangular plane comprising conductor elements extending from the apex or vertex of the triangle using either wire elements or conducting patterns on an insulating substrate. Multiple element log periodic antennas usually have four or more elements, where each element is generally triangular in shape and has a vertex and sides defined by an angle $\alpha$. More specifically, each element is comprised of at least two radial sections defined on a common side of a center line of the antenna element and on the other side by a radial line extending from the vertex at an angle $\alpha/2$. Various configurations of the radial sections are employed for the log periodic antenna.

With the log periodic antenna, it is frequently desirable to use a single antenna structure which has at least two distinct and separate modes of operation, each being excited by its own source by means of a separate coaxial feedline. An advantage of the log periodic antenna is that it can be made to operate in the two separate modes without expensive and frequency limiting connecting networks.

It is also frequently desirable to operate a log periodic antenna with one or more types of energy polarization, that is, linear polarization, circular polarization, or elliptical polarization. Heretofore, one antenna capable of operating in a variety of polarization types is known to those skilled in the art as a "four-arm cavity backed multi-mode spiral". Such an antenna consists of a four-arm spiral element installed in front of a cavity with the radio frequency energy from the four-arms of the spiral combined in a special manner by a network so as to allow two or more simultaneous modes of operation. Each mode has its own special and unique radiation pattern characteristics. While the four-arm spiral element antenna is log periodic in nature and therefore broadband, the cavity is not broadband and the combining network has certain frequency limitations. Therefore, although the "four-arm cavity backed multi-mode spiral" antenna is capable of being operated in a variety of polarization directions it has only a limited band width capability.

Primarily, the four-arm cavity backed multi-mode spiral antenna is used, when receiving radio frequency energy, to determine the direction of arrival of the received energy. Measurements are made of amplitude and phase of the received radio frequency energy at each of the coaxial feedlines. By use of an appropriate algorithm in a computer network these measurements can be used to determine the angle of arrival at the radio frequency energy. Such an antenna has a characteristic known as "axis rotation with frequency" and either the frequency of the received energy must be known or a special compensating network must be incorporated into the combining network to fully determine the direction of arrival.

Log periodic monopole antennas have also been used in conjunction with flat conducting planes for transmitting and receiving of radio frequency energy. The use of a flat conducting plane, however, does not permit the arraying of the log periodic monopole antenna elements thereby limiting such structures to only radio frequency energy polarized parallel to the antenna elements for both the transmit and receive modes.

Construction details for both the monopole elements and supporting structure for a log periodic antenna varies considerably as evidenced by the number of U.S. patents issued covering such antennas. Typically, a prior art antenna structure employing log periodic elements to transmit and receive elliptically polarized radio frequency energy consists of four log periodic elements arranged in quadrature pairs. The elements, as explained, have a generally triangular shape with the vertices of the four elements located close together. Basically, the overall antenna has a pyramidal shape outline with each of the four antenna elements forming one face of the pyramid. The edges of the adjacent elements do not make contact with each other being spaced apart a small distance. Of course, this is only an overall description of the construction of log periodic antennas, but all such antennas basically have the same general outline.

DISCLOSURE OF THE INVENTION

A dual mode log periodic monopole antenna in accordance with the present invention includes a conducting cone, four log periodic monopole elements for a first operational mode and four log periodic monopole elements for a second mode of operation. A coaxial cable is connected to the elements of the first mode of operation and a second coaxial cable is connected to the elements of the second mode of operation. Each of the eight log periodic monopole elements consists of a single planar substrate of dielectric material having a conducting material, for example, copper, deposited or printed by conventional methods, to make the conducting portion of the element. The eight monopole elements are equally spaced around the conducting cone.

Further in accordance with the present invention, there is provided a dual mode antenna including a cone having a conducting surface with a plurality of log periodic monopole elements spaced about and attached to the conducting surface. Each of the log periodic monopole elements extends radially from the conducting surface and includes a conducting pattern to establish a specific phase relationship with respect to juxtapositioned elements.

For a preferred embodiment of the invention, eight monopole elements are equally spaced about the conducting surface with alternate elements interconnected to the center conductor of a first coaxial cable and the remaining elements of the eight element array connected to the center conductor of a second coaxial cable. The outer conductor of each coaxial cable is connected to the conducting cone surface.

BRIEF DESCRIPTION OF THE DRAWINGS

The invention may best be understood by reference to the following detailed description of a preferred embodiment as illustrated in the accompanying drawings. Referring to the drawings.

DETAILED DESCRIPTION

Figure 1:
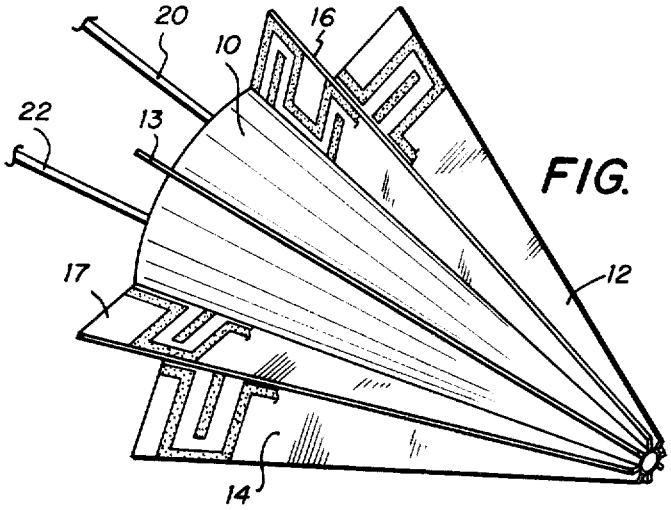
FIG. 1 is a pictorial view of a dual mode log periodic monopole array antenna having eight log periodic elements interconnected in two groups.
Figure 2:
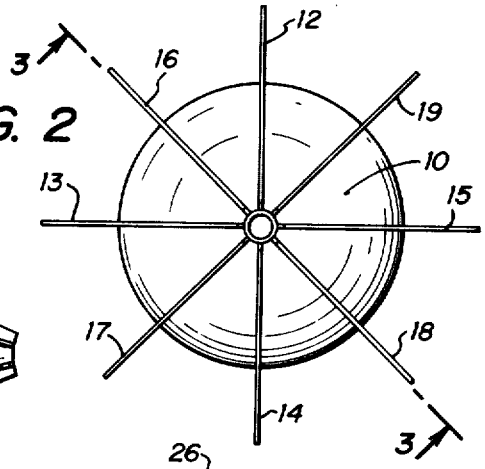
FIG. 2 is a top view of the antenna of FIG. 1 and illustrating the quadrature arrangement of the antenna elements.
Figure 3:
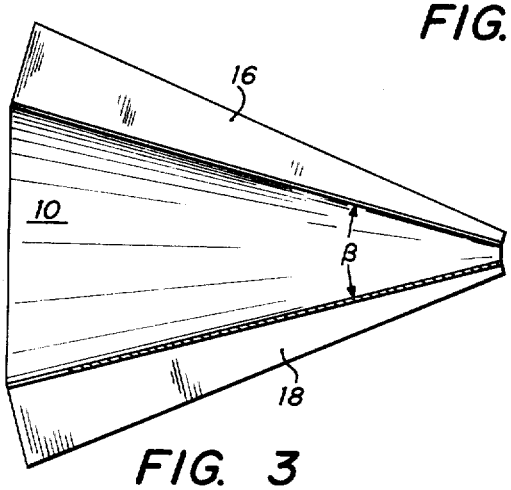
FIG. 3 is a sectional view taken along the line 3—3 of FIG. 2.

Referring to FIGS. 1 through 3, there is shown a dual mode antenna that includes a supporting cone 10 of a conducting material that has attached thereto four log periodic monopole elements 12 through 15 comprising an antenna for a first mode of operation, that is, a difference mode. A second set of four log periodic monopole elements 16 through 19 are also attached to and extend radially from the cone 10 to form a second antenna for a second mode of operation, that is, summation mode.

Connected to each of the antenna elements 12 through 15 of the difference mode is a coaxial cable 20 and connected to each of the antenna elements 16 through 19 of the summation mode is a coaxial cable 22. For the coaxial cable 20, the center conductor thereof is connected to a conducting pattern on each of the elements 12 through 15 and the outer conductor of the cable is connected to the conducting cone 10. Similarly, the center conductor of the coaxial cable 22 is connected to the conducting pattern of each of the elements 16 through 19 and the outer conductor thereof is connected to the conducting cone 10.

As best illustrated in FIG. 2, the conducting elements are equally spaced at 45° about the conducting cone 10. The elements are arrayed in quadrature pairs and thus enable the antenna of the present invention to be used in a dual mode and for both transmit and receive.

Figure 4:
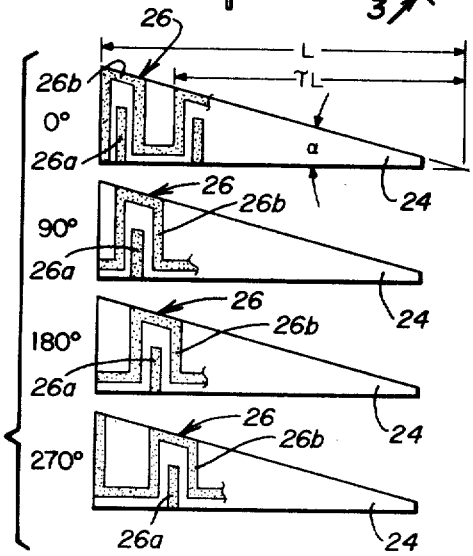
FIG. 4 is a planar view of each of the conducting patterns on the eight log periodic elements of the antenna of FIG. 1.

Referring to FIG. 4, there is shown the four conducting patterns for each of the eight log periodic monopole elements 12 through 19. The four elements illustrated in FIG. 4 are identified by the associated phase angle, namely, 0°, 90°, 180° and 270°. Each of the conducting elements is constructed on a planar substrate of a dielectric material 24 with a conducting material, for example, copper, deposited or printed by conventional methods to form the conducting pattern 26 for each of the elements.

In the construction of the antenna elements of FIG. 1, the pattern of the conductor 26 on each of the elements 12 through 19 is arranged so that radio frequency energy is transmitted or received with a specific phase. Table 1 lists the phase, and consequently the pattern for each of the eight elements 12 through 19.

TABLE 1

| ELEMENT NO. | PHASE |
|---|---|
| 12 | 90° |
| 13 | 270° |
| 14 | 90° |
| 15 | 270° |
| 16 | 0° |
| 17 | 90° |
| 18 | 180° |
| 19 | 270° |

Thus, the antenna element 16 has the 0° phase angle pattern, the element 17 has the 90° phase angle pattern and the elements 18 and 19 have the 180° and 270° phase angle pattern, respectively. For the difference mode, only the 90° phase pattern and the 270° phase pattern are utilized with these two phase patterns alternating for the four difference mode elements 12 through 15.

Each of the conducting patterns, as illustrated in FIG. 4, repeats throughout the length of the dielectric substrate 24. Each pattern is basically the same but displaced in space from the end of the substrate 24. Also, each pattern includes rectangular shaped segments periodically spaced along the substrate 24 and extending the baseline of each substrate. Each of these rectangular shaped portions 26*a* is soldered or otherwise electrically connected to the outer surface of the conducting cone 10. The portions 26(*b*) of the conducting patterns 26 are comprised of various straight-line segments with interconnecting segments at right angles or an angle determined by the shape of the dielectric substrate 24.

With reference to the conducting cone 10, typically it includes an inner cone of non-conducting material coated with a conducting material. Although, as an alternative, the conducting cone may be constructed entirely from a conducting material.

The performance of the dual mode antenna of the present invention depends upon at least the following five parameters:

1. Cone angle - $\beta$
2. Element angle - $\alpha$
3. Element scale factor - Y
4. Cone base diameter - D
5. Cone tip diameter - d.

The cone angle $\beta$ is best illustrated in FIG. 3 and for a typical antenna as equal to 15° degrees. The element angle $\alpha$ is illustrated in FIG. 4 for each of the patterns shown and in the preferred embodiment of the invention is equal to 7.5° degrees. The element scale factor Y is also illustrated in FIG. 4 and in a preferred embodiment as equal to 0.85. With regard to the cone based diameter D, and the cone tip diameter d, these are also best illustrated in FIG. 3 and for a cone angle of 15° degrees the cone base diameter D is equal to 100 millimeters and the cone tip diameter d is equal to 6 millimeters.

It should be understood that each of the values given above for a preferred embodiment of the invention may be varied over a wide range with the antenna performing and functioning in a dual mode operation. Also, it should be understood that the values given are for only one embodiment of the invention; for other antennas some of the above parameters will be as listed while others will be varied and the antenna will perform as a dual mode antenna.

As illustrated in the Figures, the log periodic monopole antenna of the present invention includes four log periodic monopole elements 16 through 19 with progressive phasing, that is, 0°, 90°, 180°, 270° extending radially from the conducting cone and connected to the coaxial cable 22. Also, the antenna includes four log periodic monopole elements 12 through 15 constructed with repetitive phasing, that is, 90°, 270°, 90° and 270°, mounted at right angles on the conducting cone 10 and connected to the coaxial cable 20.

What has been described and shown herein is only a single preferred embodiment of the present invention, it will be understood that this embodiment is exemplary only, and many variations and changes therein will be readily apparent to those skilled in the art without departing from the spirit and scope of the invention. For example, the various parameters given in the description may be varied to produce an antenna that will still function in a dual mode log periodic manner.

I claim:

1. A dual mode antenna, comprising:

a cone having a conducting surface, a first plurality of log periodic monopole elements spaced about and attached to said conducting surface and extending radially therefrom, said first plurality of elements having a phase relationship for operating in a first mode, and a second plurality of log periodic monopole elements interdigitated with said first plurality and spaced about and attached to said conducting surface and extending radially therefrom, said second plurality of elements having a phase relationship distinct from the phase relationship of said first plurality for operating in a second mode, wherein said first plurality of monopole elements has a pattern to establish a progressive phase relationship around said cone.

2. A dual mode antenna, comprising:

a cone having a conducting surface, a first plurality of log periodic monopole elements spaced about and attached to said conducting surface and extending radially therefrom, said first plurality of elements having a phase relationship for operating in a first mode, and a second plurality of log periodic monopole elements interdigitated with said first plurality and spaced about and attached to said conducting surface and extending radially therefrom, said second plurality of elements having a phase relationship distinct from the phase relationship of said first plurality for operating in a second mode, wherein said second plurality of monopole elements has a pattern to establish a repetitive phasing around said cone.

3. A dual mode antenna as set forth in claim 1 or 2 wherein each of said monopole elements is attached along the longitudinal axis to said conducting surface.

4. A dual mode antenna, comprising:

a cone having a conducting surface, four first mode log periodic monopole elements equally spaced about and attached to said conducting surface and extending radially therefrom, each of said four first mode monopole elements having a pattern to establish a phase relationship for operating in a first mode, and four second mode log periodic monopole elements interdigitated with said four first mode monopole elements and spaced about and attached to said conducting surface and extending radially therefrom, each of said four second mode monopole elements having a phase relationship distinct from the phase relationship of said first plurality for operating in a second mode.

5. A dual mode antenna as set forth in claim 4 wherein said four first mode monopole elements have progressive phasing arranged in opposed groups of two, and said four second mode monopole elements have repetitive phasing interdigitated with said elements having progressive phasing.

6. A dual mode antenna as set forth in claim 4 wherein said four first mode monopole elements having progressive phasing have a transmit/receive phasing of 0°, 90°, 180° and 270°, respectively.

7. A dual mode antenna as set forth in claim 4 wherein said four second mode monopole elements having repetitive phasing have a transmit/receive phasing of 90°, 270°, 90° and 270°, respectively.

8. A dual mode antenna as set forth in claim 4 including a first coaxial cable having a center conductor interconnected to said four elements having progressive phasing, and a second coaxial cable having a center conductor interconnected to said four elements having repetitive phasing.

9. A dual mode antenna as set forth in claim 4 wherein the outer conductor of said first and second coaxial cables is interconnected to said conducting surface.

10. A dual mode antenna, comprising:

a cone having a conducting surface, eight log periodic monopole elements each including a planar substrate of dielectric material having a conducting material thereon forming the conducting portion of the element, each of said planar substrates equally spaced about said conducting surface and extending radially therefrom with each of said conducting portions connected to the conducting surface and having a pattern to establish a specific transmission or receive phase relationship with respect to juxtapositioned elements.

11. A dual mode antenna set forth in claim 10 wherein four of said conducting portions of the elements have progressive phasing arranged in opposed groups of two and four of said conducting portions of said elements have repetitive phasing interdigitated with said elements having progressive phasing.

12. A dual mode antenna as set forth in claim 10 wherein the conducting material on the planar substrate is patterned to establish a specific phase relationship with respect to juxtapositioned elements.

* * * * *